US006802084B2

(12) United States Patent
Ghertner et al.

(10) Patent No.: US 6,802,084 B2
(45) Date of Patent: Oct. 12, 2004

(54) TANK LEAK DETECTION AND REPORTING SYSTEM

(75) Inventors: Steve Ghertner, Nashville, TN (US); Vince Luciani, Charlotte, NC (US)

(73) Assignee: Ghertner Automation, Inc., Nashville, TN (US)

( * ) Notice: Subject to any disclaimer, the term of this patent is extended or adjusted under 35 U.S.C. 154(b) by 101 days.

(21) Appl. No.: 10/068,163

(22) Filed: Feb. 5, 2002

(65) Prior Publication Data

US 2003/0145371 A1 Aug. 7, 2003

(51) Int. Cl.[7] ..... E03D 1/00
(52) U.S. Cl. ..... 4/314; 4/415; 340/605
(58) Field of Search ..... 4/314, 353, 427, 4/668, 415; 340/605, 606, 616

(56) References Cited

U.S. PATENT DOCUMENTS

| | | | | | |
|---|---|---|---|---|---|
| 3,365,710 | A | | 1/1968 | Duplessy | 340/606 X |
| 3,984,877 | A | | 10/1976 | Kirby | 4/314 |
| 4,011,553 | A | * | 3/1977 | Delgado Barri | 340/605 X |
| 4,547,768 | A | | 10/1985 | Kulhavy | 340/605 X |
| 4,916,762 | A | | 4/1990 | Shaw | 4/415 X |
| 5,125,120 | A | | 6/1992 | Baron | 4/415 |
| 5,144,700 | A | | 9/1992 | Martin | 4/415 |
| 5,287,565 | A | * | 2/1994 | Auman et al. | 4/415 |
| 5,436,615 | A | * | 7/1995 | Williams | 340/616 |
| 5,637,789 | A | * | 6/1997 | Lawson | 340/606 X |

OTHER PUBLICATIONS

"Flood Prevention," *The Journal of Light Construction,* Oct. 2001, p. 142.

"Leak Detection System," *The Journal of Light Construction,* Jul. 2001, p. 56.

Product literature from Dorlen Products entitled "Water Alert® Sensor Cable, 6 pages, undated".

Product literature from Dorlen Products entitled "Ceiling Guard® Water Leakage Sensing System, 7 pages undated".

Product literature from Dorlen Products, Inc. entitled "Water Alert® Water Sensing System," pp. 1–16, undated.

Product literature from Inovonics regarding Tapwatch® Wireless Submetering, Jul. or Aug. 1998.

Product literature from Inovonics entitled "Inovonics Tapwatch System: The Leader in Wireless Submetering," 2000.

"California company taps into lucrative sub–metering market," by Jeff Dick, *U.S. Water News,* Apr. 2001, p. 5.

"New Technology for Promotion of Water Conservation," by Jerome Peacock, *CAA Perspective Magazine,* Mar. 2001, pp. 28–29.

Product literature from Wellspring Wireless Utility Services regarding the "Aqura System," 2 pages, undated.

Product literature from Fluidmaster® entitled "Leaky Toilets Foiled by New Breed of Fill Valve," Mar., 2001.

* cited by examiner

*Primary Examiner*—Robert M. Fetsuga
(74) *Attorney, Agent, or Firm*—LAVA Group Law by Smith & Frohwein; Gregory Scott Smith; Wm. Brook Lafferty

(57) ABSTRACT

A leak detection and reporting system for detecting and reporting different types of leaks. Different alarms are activated in response to different types of leaks. The present invention includes a timing module and a water flow sensor. The timing module measures a standard fill time required to properly fill a reservoir. A lower time threshold and an upper time threshold are then calculated based upon the standard fill time. A first alarm may be activated if a subsequent fill time is below the lower time threshold to identify a small leak. Also, a second alarm may be activated if a subsequent fill time is above the upper time threshold to identify a larger leak.

2 Claims, 3 Drawing Sheets

TANK LEAK DETECTION AND REPORTING SYSTEM

TECHNICAL FIELD

The present invention relates to water level monitors and, more particularly, relates to leak detection in water reservoirs of standard tank-type toilets.

BACKGROUND OF THE INVENTION

Eliminating the wasteful use of water is a desirable goal for home owners as well as most business establishments such as apartments and hotels. Leaky toilets are a major source of wasted water. Without periodic maintenance on toilets, a leak is sure to occur because of the intermittent flow of water through the toilet as well as the storage of water in the toilet.

Typical toilets include a tank or reservoir for storing water for use when flushing. The reservoir of a toilet has a large hole in its bottom which permits the water to flow from the reservoir and down into the toilet bowl. A large rubber seal, commonly referred to as a flapper, is seated in the hole in the bottom of the reservoir which is lifted when water is to be drained from the reservoir and into the toilet bowl. When the water in the reservoir is evacuated from the reservoir, an inlet valve permits water back into the toilet to refill the reservoir.

Also, within the reservoir is an overflow pipe. The water flowing into the reservoir through the inlet valve to refill the reservoir passes through a refill tube assembly extending from the inlet valve and over to the overflow pipe. In a common embodiment, a float moves up and down along the length of the body of the inlet valve as the water level rises and descends, respectively. The float descends when the toilet is flushed and water goes into the toilet bowl. The float rises when the reservoir is being refilled and, when the float reaches a preset refill level, the influx of water into the reservoir through the inlet valve is shut off.

A large number of the leaks occur at the juncture between the hole in the bottom of the reservoir and the flapper when the flapper is not properly seated in the opening. Often the flapper no longer fits the opening in the reservoir or the flapper is stuck in the open position. Over a period of time, such leaks could result in a substantial expense.

Moreover, a large number of leaks go undetected because water is not leaked onto the floor where it can be seen. For example, water may be wasted as a result of a slow leak between the flapper and the reservoir allowing water to flow down the drain. If the flapper is stuck in the open position, a large amount of water is allowed to flow continuously from the reservoir, into the toilet bowl and down the drain. Also, when the inlet valve to the reservoir has a leak, water is continually let into the reservoir which fills the reservoir and causes water to prematurely fill the overflow pipe. Again, the water then flows into the bowl and eventually down the drain. In each of these examples, the leak likely will not be detected and large amounts of water will be wasted.

Therefore, there is a need for an improved leak detection and reporting system for detecting leaks not visible to the eye. The new leak detection and reporting system must also accurately identify the type of leak.

SUMMARY OF THE INVENTION

The present invention solves the above-identified problems by providing an improved leak detection and reporting system. The present invention monitors the time it takes to refill a reservoir to ascertain whether a leak exists as well as the type of leak. Different alarms are activated in response to different types of leaks.

Generally described, the present invention includes a timing module and a water flow sensor. The timing module has a calibration mode for measuring a standard fill time required to properly fill a reservoir of a toilet. A lower time threshold and an upper time threshold are calculated based upon the standard fill time. Different alarms may be activated based upon the duration of the leak. For example, a first alarm may be activated if a subsequent fill time is below the lower time threshold to identify a small leak. Also, a second alarm may be activated if a subsequent fill time is above the upper time threshold to identify a larger leak.

According to one aspect of the invention, the water flow sensor includes an elongated tube for receiving water. The tube has an opening which extends from one end to the other. The water flow sensor includes a pair of metal contacts which permits the measuring of the resistance of the water flow between the contacts as the water flow passes through the water flow sensor. The pair of elongated contacts extend across the opening in the tube in substantially a diagonal manner. In one embodiment, the elongated contacts extend outwardly from one of the ends of the tube to detachably secure the water flow sensor within the overflow pipe.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
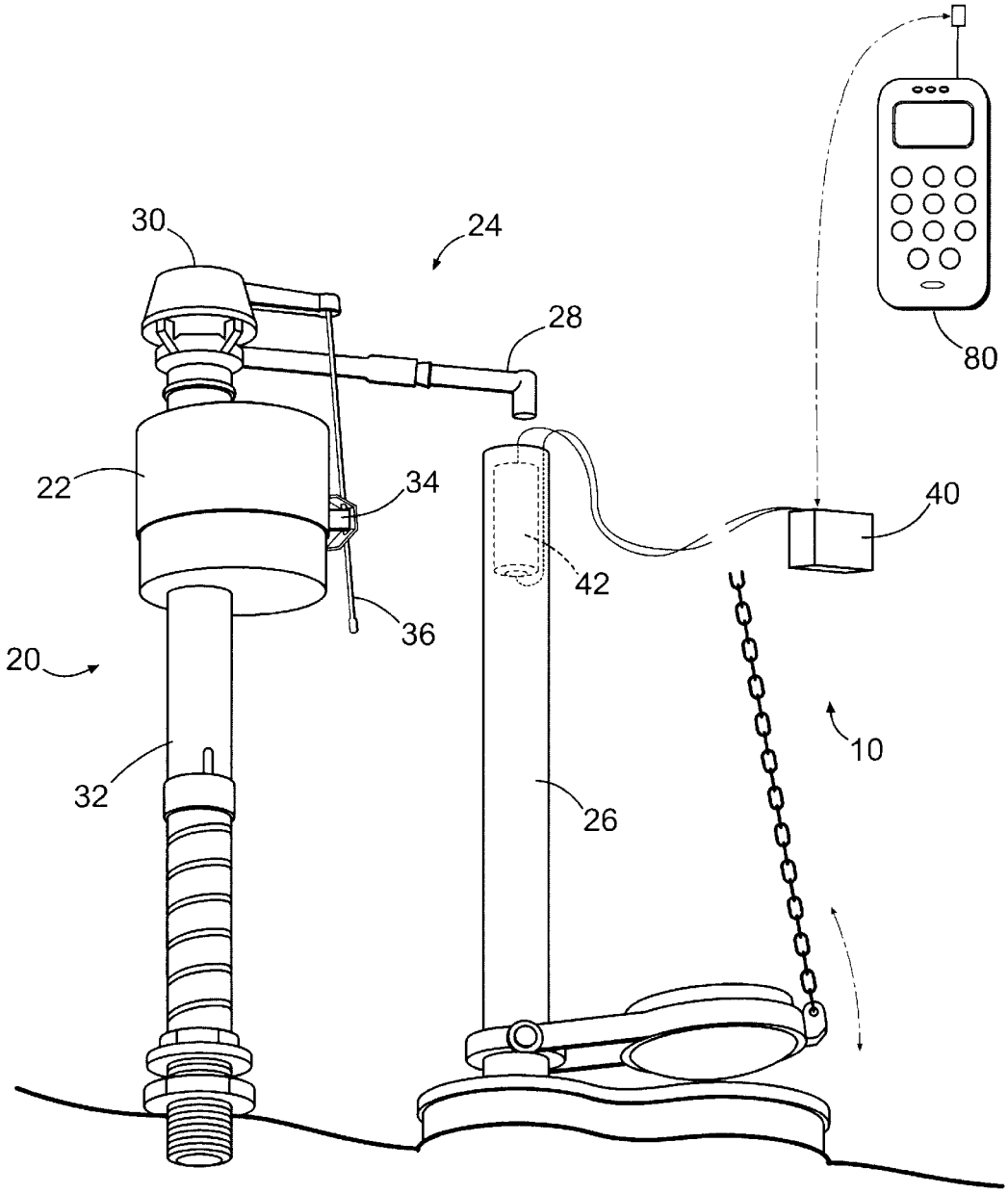
FIG. 1 illustrates a perspective view of the present invention utilized with the components typically within a reservoir of a standard toilet.

Referring now to the drawings in which like numerals indicate like elements throughout the several views, FIG. 1 illustrates an exemplary embodiment of an improved leak detection and reporting system 10. Preferably, the leak detection and reporting system 10 is utilized within a reservoir of a standard toilet (not shown). While a particular embodiment of the present invention may be described with reference to a particular embodiment in a particular application, it is understood that the present invention may be adapted for use in a variety of applications requiring leak detection and reporting of many different types of leaks.

As best shown in FIG. 1, toilets typically include, within the reservoir, an inlet valve 20, a float 22, a refill tube assembly, 24 and an overflow pipe 26. The operation and function of the inlet valve 20, the float 22, the refill tube assembly, 24 and the overflow pipe 26 are known in the industry. The water flowing into the reservoir through the inlet valve 20 to refill the reservoir passes through a refill tube assembly 24 extending from the inlet valve 20 and over to the overflow pipe 26. The distal end of the refill tube assembly 24 often has an angle adapter 28.

The inlet valve 20 includes a valve top 30 and a valve body 32. The float 22 descends on the valve body 32 when the toilet is flushed and rises on the valve body 32 when the reservoir is being filled. The height of the water within the reservoir may be adjusted by adjusting the water level adjustment clip 34 located on the link 36 of the inlet valve 20.

Figure 2:
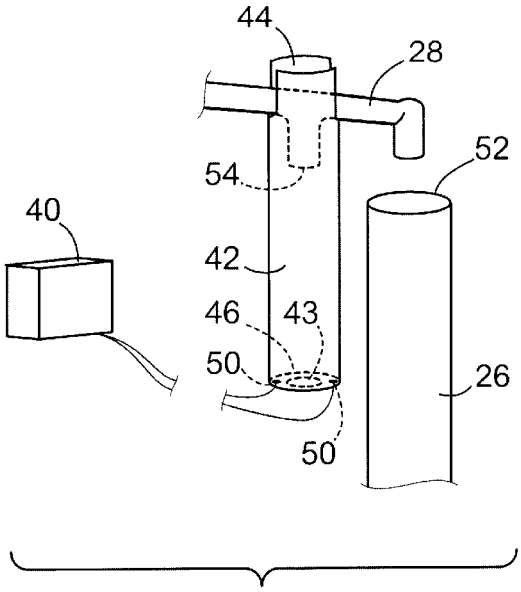
FIG. 2 illustrates another embodiment of the present invention wherein the water flow sensor is placed outside an overflow pipe typically used within a reservoir of a standard toilet.

As shown in FIG. 2, one embodiment of the leak detection and reporting system 10 includes a software timing module 40 and a water flow sensor 42. The timing module 40 includes internal electronic circuitry for monitoring the timing functions of the flow of water from the refill tube assembly 24 through the water flow sensor 42. Any known timing circuit 120 may be used which performs the function of measuring and storing a standard fill time required to properly fill the reservoir with water from the refill tube assembly 24 following a flush. Also, a sensor may be used to detect when a lever (not shown) is actuated for initiating water flow from the reservoir into the bowl.

The timing module 40 must also be able to calculate lower and upper thresholds, based upon the standard fill time. The lower and upper thresholds act as limits for determining when to activate an alarm as described below. One method of calculating the lower threshold is to divide the standard fill time by two. On the other hand, the upper threshold may be calculated by multiplying the standard fill time by three. Preferably, the timing module 40 allows for more than one occurrence of exceeding either the lower or upper threshold before activating an alarm.

Figure 3:
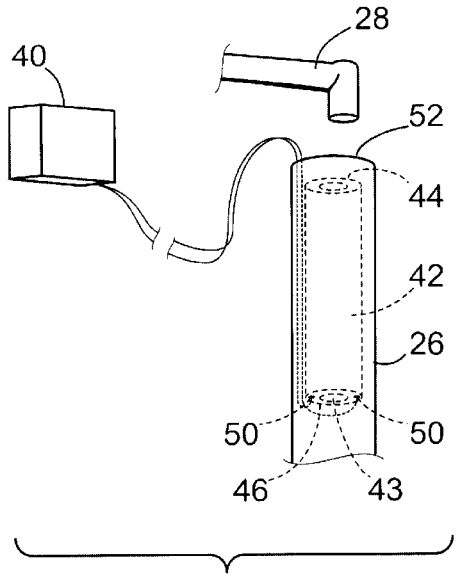
FIG. 3 illustrates a partial perspective view of one embodiment of the present invention wherein a water flow sensor is placed within an overflow pipe.

The leak detection and reporting system 10 also includes the water flow sensor 42 as shown in FIGS. 2 and 3. The water flow sensor 42 includes an elongated tube, preferably cylindrical, but may be otherwise shaped, with first and second ends 44 and 46, respectively. An opening 43 extends through the length of the elongated tube from the first end 44 to the second end 46. The second end 46 includes a pair of metal contacts 50. The metal contacts 50 are displaced from one another, but are located close enough to each other so that a nominal impedance or sensor resistance of approximately between 5K Ohms to approximately 20K Ohms of DC resistance exists between the contacts 50 when water is passing through the opening 43 in the water flow sensor 42. However, the resistance may vary depending on the chemical make-up of the water. Therefore, it is also within the scope of the present invention to have a sensor resistance outside the range of approximately 5K Ohms to 20K Ohms as described above.

Figure 6:
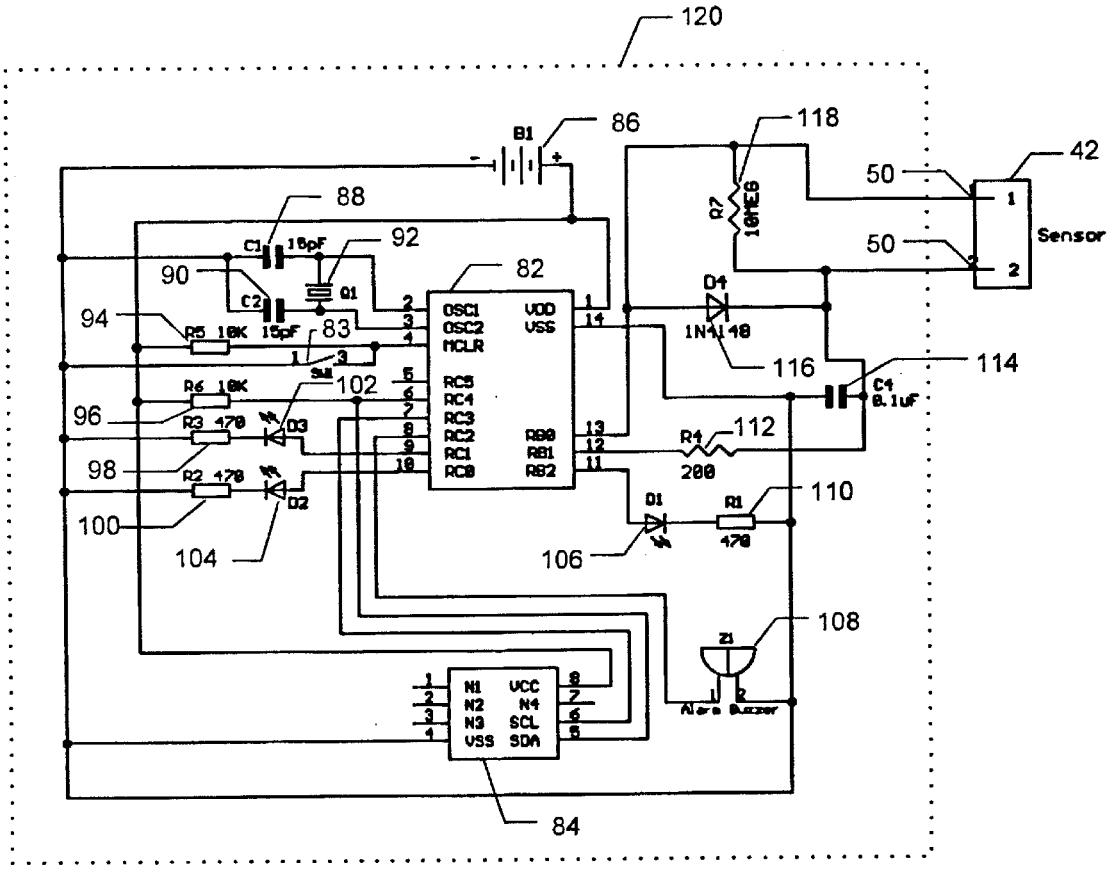
FIG. 6 schematically illustrates a preferred embodiment of a water flow timing circuit.

The water flow sensor 42 includes additional separate circuitry included within the housing of the timing module 40 or, alternatively, the separate circuitry of the water flow sensor 42 may be contained elsewhere. In a exemplary embodiment of the present invention, the water flow sensor 42 is connected to timing circuitry 120. The timing circuitry 120 includes circuitry for measuring the fill time and circuitry for comparing the fill time to the standard fill time and to the threshold times. Any circuit capable of timing the fill time and comparing the fill time to the standard fill time may be used. In an exemplary embodiment of the present invention, a microprocessor 82 is used to perform the timing and comparison functions. Additionally a memory device 84 is included for storing the standard fill time. In an exemplary embodiment of the present invention, the memory device 84 is used as backup memory for the microprocessor 82. If the microprocessor 82 losses the data for the standard fill time or other data, due to power failure or other microprocessor 82 fault, the microprocessor 82 may access the data from the memory device 84. Any microprocessor may be used including, but not limited to a Microchip PIC series PIC16C505. Additionally, any memory device may be used including, but not limited to a Microchip 24LC00. FIG. 6 schematically illustrates a preferred embodiment of a water flow monitoring circuit. FIG. 6 is included to provide an exemplary timing circuit capable of performing the necessary timing and comparison functions. Those skilled in the art are familiar with such circuits and will recognize that the part numbers and component values provided are for example only and not limitation.

In one embodiment of the present invention, the water flow sensor 42 includes a 0.1 uF capacitor 114 connected to one of the sensor contacts 50. The capacitor 114 is also connected to the circuit ground. The other contact 50 is then connected to port A of a microcontroller 82. A 10 MEG Ohm resistor 118 and a diode 116 are wired in parallel with the two contacts 50 of the water flow sensor 42. A IN4148 diode may be used for diode 116. A 200-Ohm resistor 112 is connected between the node of the capacitor 114 and the contact and a port B of the microcontroller 82.

Port A of the microcontroller 82 is set as an output and set HIGH to charge the capacitor 114. The diode 116 is then forward biased to decrease the time required to charge the capacitor 114. Port A is then set LOW to act as a circuit ground. In this case, the circuit is modeled as sensor resistance (Rs) in parallel with a 10 MEG Ohm resistor 118 in parallel with the capacitor 114. The voltage at the charged end of the capacitor 114 is monitored through the 200 Ohm resistor 112 into Port B of the microcontroller 82. The DC voltage drops off in accordance with the RC time constant where the total resistance (Rtotal) is the parallel resistance of the 10 MEG Ohm resistor 118 and Rs. A calibrated timer, implemented in the microprocessor 82, measures the time it takes for the voltage to drop from Vmax (equal to circuit VCC) to VINlow of the microcontroller 82. From this time measurement, the actual resistance value of Rtotal can be calculated using:

$$V=Vo * e^{-(t/RC)}$$

where:

V=voltage input to Port A (volts)

Vo=initial supply voltage on capacitor, which equals VCC (volts)

t=discharge time of capacitor (seconds)

C=0.1 uF

R=Rtotal=Rs in parallel with 10 MEG

If there is no water present between the contacts 50, the Rtotal equals approximately 10 MEG Ohms. If water is present, Rtotal drops to 10 MEG Ohms in parallel with the sensor impedance, Rs, which is 5K to 20K Ohms.

The charging and discharging of the capacitor 114 through the water flow sensor 42 prevents electrolytic action. Because the current flow is reversed periodically, ions are not attracted to only one contact 50. If the current flow was not reversed, ions would be attracted to only one contact 50 because the charge on the one contact 50 would not change. This would lead to a buildup of deposits on the one contact 50 and a degradation of sensor 42 performance.

Alternatively, instead of measuring sensor resistance directly, an Analog to Digital converter may be configured to directly read the voltage across the sensor in order to calculate the sensor resistance. Capacitive sensing could also be used to detect water flow from the refill tube.

The water flow sensor 42 can build up deposits over time that have a high resistance without the presence of water between the contacts 50. Also, adhesion of small droplets of water in the water flow sensor 42 can provide a resistance path for current to flow between the contacts 50 without the presence of water. The deposit build ups and the resistance paths due to water droplets, commonly referred to as micro-channels, can have a resistance value in the range of tens of thousands of Ohms to millions of Ohms. Therefore, resistance thresholds may be implemented to reduce or eliminate false sensing of water flow in the water flow sensor 42.

Software implemented by the present invention utilizes hysteresis to reduce the occurrence of false indications of the presence of water. A lower threshold of approximately 25K Ohms and a higher threshold of approximately 150K Ohms is recommended. Therefore, the water flow sensor 42 does not recognize the existence of water flow unless the measured resistance between the contacts 50 is below approximately 25K Ohms. Water flow is determined to have stopped in the water flow sensor 42 when the measured resistance between the contacts 50 exceeds approximately 150K Ohms.

In another alternative embodiment, the thresholds for eliminating false indicators of water flow may be set dynamically. For example, when the actual resistance value is calculated, the value could be the average over a particular number of cycles. Thus, if the sensor resistance changes over time, the thresholds could be self-adjusting.

The water flow sensor 42 may be utilized outside the overflow pipe 26. FIG. 2 illustrates the water flow sensor 42 adjacent the exterior of the overflow pipe 26. However, a portion of the water flow from the refill tube assembly 24 must then be diverted to the water flow sensor 42 while the remaining portion of the water flow through the refill tube assembly 24 flows into the top 52 of the overflow pipe 26. In such case, as shown in FIG. 2, the refill tube assembly 24 is modified to include an additional outlet 54, shaped like angle adapter 28. Alternatively, the refill tube assembly 24 may be modified merely by inserting a hole in the under side of the refill tube assembly 24. In embodiments where the water flow sensor 42 is position outside of the overflow pipe 26, a portion of the water flow path passing through the water flow sensor 42 is displaced from the remaining portion of water flow passing through the overflow pipe 26. However, rising water within the reservoir due to a leaky inlet valve 20 may also be detected by water flow sensor 42 positioned outside the overflow pipe 26. Because the water flow sensor 42 is positioned outside the overflow pipe 26, the rising water in the reservoir will contact the contacts 50 as a result of passing into the bottom of the water flow sensor 42, through opening 43. In such case, no water flow is required through the top of sensor 42.

Alternatively, as best shown in FIG. 3, the water flow sensor 42 may be configured to be received and retained within the overflow pipe 26 such that water flowing from the angle adapter 28, on the end of the refill tube assembly 24, may be received through the first end 44 of the water flow sensor 42. Preferably, the water flow sensor 42 in concentric with the overflow pipe 26 and is oriented near a top 52 of the overflow pipe 26. In this embodiment, a water flow path through the reservoir of the toilet exists where water passes from the inlet valve 20 to the refill tube assembly 24 where at least a portion of the water flow from the refill tube assembly 24 continues through the water flow sensor 42 and through at least a potion of the overflow pipe 26 in substantially a simultaneous manner.

Figure 4:
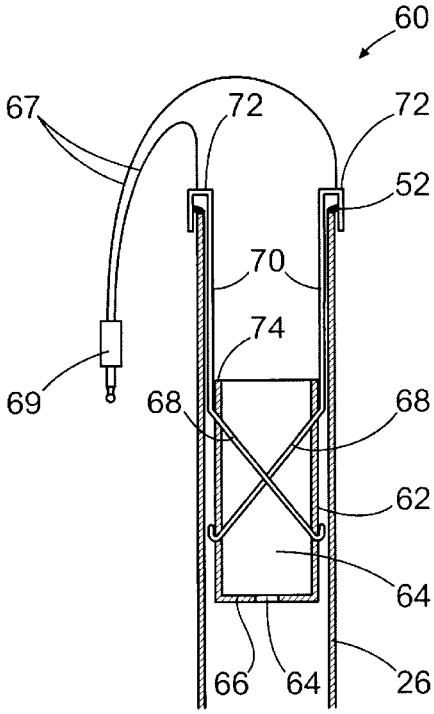
FIG. 4 illustrates one embodiment of a water flow sensor utilized within the overflow pipe.
Figure 5:
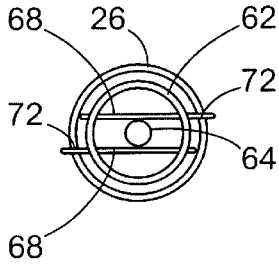
FIG. 5 illustrates a top view of the water flow sensor shown in FIG. 4.

FIGS. 4 and 5 illustrate an alternative embodiment of a water flow sensor 60 of the present invention which minimizes the presence of water droplets on contacts which may provide a resistance path for current to flow between the contacts without the actual presence of water flow, as described above. The water flow sensor 60 includes an elongated tube 62 with an opening 64 therethrough. However, the opening 64 through the water flow sensor 62 is preferably wider through out most of its length when compared to a hole 64 in a bottom 66 of the elongated tube 62. The water flow sensor 60 also includes a pair of displaced and elongated contacts 68 connected to lead wires 67 and plug 69. The plug 69 is configured to be received into the timing module 40.

Each of the elongated contacts 68 extend across the opening 64 through the elongated tube 62 in substantially a diagonal manner, relative the length of the opening 64, as best shown in FIG. 4. The elongated contacts 68 extend across the opening 64 in substantially opposite directions relative to each other so that water droplets able to rest upon or against one of the pair of contacts 68 can not easily rest upon or against the other of the pair of contacts 68 as well. Because the elongated contacts 68 are oriented opposite to each other, the surface tension of a droplet of water resting between the contacts 68 is more easily broken. FIG. 5 best illustrates the distance between each of the contacts 68.

Moreover, each of the pair of contacts 68 is preferably sufficiently long enough such that portions 70 of the contacts 68, with distal ends 72, outwardly extend beyond a top end 74 of the elongated tube 62. The portions 70 should be approximately parallel to the length of the elongated tube 62, but misaligned with the elongated tube 62 as shown in FIG. 4. The distal ends 72 may be configured to detachably secure the water flow sensor 60 within the overflow pipe 26. For example, the distal ends 72 may be bent back onto themselves to form a hook-like shape as shown in FIG. 4. Preferably, the elongated contacts 68 extend from the top of the water flow sensor 60 from within the overflow pipe 26 and out over the top end 52 of the overflow pipe 26 to the overflow pipe's exterior.

The embodiment shown in FIGS. 4 and 5, may also be used to indicate a rising water level within the reservoir, often due to leaks at the inlet valve 20, before the rising water over flows into the overflow pipe 26. Because the distal ends 72 extend over the top 52 of the overflow pipe 26, the sensor 60 will detect the rising water.

The present invention contemplates the activation of different alarms for different types of leaks. Once a leak has been detected, a first alarm is activated if a subsequent fill time is below the lower time threshold to identify a slow leak at the flapper seat. A second alarm may be activated if another subsequent fill time is above the upper time threshold to identify when the flapper is stuck in an open position. The second alarm may also be activated to indicate a leak at the inlet valve 20 as a result of water in the reservoir being about to over flow into the overflow pipe 26, as determined by a high water level in the reservoir. If the water level is at the overflow point, either water is leaking past the inlet valve 20 into the reservoir, or the water level adjustment is not set properly.

Although a particular type of alarm may be described, other types of alarms not expressly described herein are also within the scope of the present invention. Alarms activation can be local or remote. Local alarms can include visual alarms, such as light emitting diodes (LEDs), as well as audible alarms. In any case, the length of the alarm may be used to distinguish different types of leaks. For example, a shorter alarm may be activated to indicate a small leak and a longer alarm may be activated to indicate a larger leak. Alternatively, a visual alarm may be used to indicate one type of leak and an audible alarm may be used to indicate another type of leak. Preferably, once a particular alarm is initially activated, the alarm is toggled between off and on to conserve battery life. Preferably, the timing module 40 includes the alarm circuitry. For example, LEDs 102, 104, 106 can be imbedded within the housing of the timing module 40 and a portion of the circuitry within the timing module 40 may be dedicated to lighting the LEDs 102, 104, 106.

Also, the present invention includes transmitting alarms to be received by remote devices such as hand held wireless devices 80 or an Internet-enabled PC. The timing module 40, described above, may include the additional separate circuitry for transmitting a signal to the remote device. Remote annunciation can be handled by a variety of wired and wireless data protocols which are known. In view of the many different types of protocols, hand held devices, computers, and computer platforms that can be used to receive and transmit alarms, it is not practical to provide a representative example that would be applicable to these many different systems. Each user would be aware of the protocol and tools which are more useful for that user's needs and purposes to implement the instant invention.

The foregoing exemplary embodiment may be conveniently implemented with the use of one or more program modules as well as hardware components. The present invention may conveniently be implemented in a program language such as "C"; however, no particular programming language has been indicated for carrying out the various tasks described because it is considered that the operation, steps, and procedures described in the specification are sufficiently disclosed to permit one of ordinary skill in the art to practice the instant invention.

The use of the leak detection and reporting system 10 as described above constitutes an inventive method of the present invention in addition to the leak detection and reporting system 10 itself. In practicing the method of the present invention wherein different alarms are activated in response to different types of leaks, the steps include calculating a standard fill time for filling a toilet bowl with water as described above. The method then includes calculating a lower time threshold and an upper time threshold based upon the standard fill time. The method also includes activating a first alarm when a subsequent fill time is below the lower time threshold to identify a slow leak or activating a second alarm if the subsequent fill time is above the upper time threshold to identify a faster leak. The method may also include the step of sending the alarms to a remote device as described above.

The present invention has been illustrated in relation to particular embodiments which are intended in all respects to be illustrative rather than restrictive. Those skilled in the art will recognize that the present invention is capable of many modifications and variations without departing from the scope of the invention. Accordingly, the scope of the present invention is described by the claims appended hereto and supported by the foregoing.

What is claimed is:

1. In a reservoir of a toilet having an inlet valve with a refill tube assembly and an overflow pipe, a water flow path through the reservoir of the toilet, said water flow path passing from the inlet valve to a refill tube assembly, the improvement comprising a portion of said water flow path continuing from the refill tube assembly through a water flow sensor and into the reservoir, and a remaining portion of said water flow path continuing from the refill tube assembly through the overflow pipe to the exterior of the reservoir, wherein said portion of said water flow path through said water flow sensor is displaced from said remaining portion of said water flow path passing through the overflow pipe.

2. The water flow path of claim 1 wherein said water flow sensor is adapted to detecting leaking inlet valves as well as leaks between a flapper and an opening in the reservoir.

* * * * *